US011382828B2

(12) United States Patent
Jagger

(10) Patent No.: US 11,382,828 B2
(45) Date of Patent: Jul. 12, 2022

(54) BABY BURPING DEVICE

(71) Applicant: Sandeep Jagger, Providenciales (TC)

(72) Inventor: Sandeep Jagger, Providenciales (TC)

( * ) Notice: Subject to any disclaimer, the term of this patent is extended or adjusted under 35 U.S.C. 154(b) by 454 days.

(21) Appl. No.: 16/414,063

(22) Filed: May 16, 2019

(65) Prior Publication Data

US 2019/0350804 A1 Nov. 21, 2019

Related U.S. Application Data

(60) Provisional application No. 62/673,290, filed on May 18, 2018.

(51) Int. Cl.
*A61H 23/02* (2006.01)
*A61H 37/00* (2006.01)

(52) U.S. Cl.
CPC ..... *A61H 23/02* (2013.01); *A61H 37/00* (2013.01); *A61H 2201/1645* (2013.01); *A61H 2201/1676* (2013.01); *A61H 2203/0468* (2013.01); *A61H 2205/081* (2013.01)

(58) Field of Classification Search
CPC ..... A61H 23/02; A61H 37/00; A61H 2201/1645; A61H 2201/1676; A61H 2205/081; A61H 2203/0468; A61H 2201/1623; A61H 2201/1604; A61H 2201/1619; A61H 2201/1215; A61H 23/0254; A61H 23/006; A61H 2201/0192; A61H 2201/0161; A61H 2201/1609; A61H 2201/5025; A61H 1/00
See application file for complete search history.

(56) References Cited

U.S. PATENT DOCUMENTS

| | | | | |
|---|---|---|---|---|
| 1,896,351 A | | 2/1933 | Doran | |
| 3,234,933 A | | 2/1966 | Martin | |
| 3,299,450 A | * | 1/1967 | Gottfried | A47D 11/005 5/100 |
| 3,403,674 A | * | 10/1968 | Alimanestiano | A61H 7/004 601/134 |
| 3,461,859 A | | 8/1969 | Fortnam | |
| 3,580,245 A | | 5/1971 | Dill | |
| 3,779,238 A | | 12/1973 | Cutler | |
| 4,025,809 A | | 5/1977 | Teranishi | |
| 4,633,856 A | | 1/1987 | Havstad | |
| 4,681,096 A | | 7/1987 | Cuervo | |

(Continued)

FOREIGN PATENT DOCUMENTS

CN 103284522 A * 9/2013

*Primary Examiner* — Timothy A Stanis
*Assistant Examiner* — Matthew R Moon
(74) *Attorney, Agent, or Firm* — Gutwein Law; Greg Geiser

(57) ABSTRACT

A device configured to support an infant in a prone position to automatically burp the infant while retained within the device. The device having a base portion, a resting portion, and a movable arm portion. A pair of legs are positioned on opposed ends of the base portion extending perpendicular to a width of the base portion for supporting the device. The movable arm portion coupled to a motor to move the arm towards and away from the resting portion in a back and forth motion. The movable arm portion and the resting portion are movable along their length to an extended position to fit several lengths and sizes of infants placed within the device.

16 Claims, 7 Drawing Sheets

(56) References Cited

U.S. PATENT DOCUMENTS

| | | | | |
|---|---|---|---|---|
| 4,721,100 | A * | 1/1988 | Hengl | A61H 7/002 601/117 |
| 4,984,568 | A * | 1/1991 | Persaud | A61H 7/008 601/126 |
| 6,174,298 | B1 * | 1/2001 | Quinn | A61H 15/00 601/103 |
| 6,585,668 | B2 * | 7/2003 | Nissim | A61H 7/001 601/103 |
| 2002/0072692 | A1 * | 6/2002 | Batula | A61H 23/06 601/84 |
| 2005/0028286 | A1 * | 2/2005 | Smart | A47D 15/008 5/655 |
| 2016/0136039 | A1 * | 5/2016 | Spence | A61H 7/004 601/46 |
| 2017/0266077 | A1 * | 9/2017 | Mackin | A61G 13/125 |
| 2019/0269258 | A1 * | 9/2019 | Descamps | A47D 13/10 |
| 2020/0046141 | A1 * | 2/2020 | Mu | A47D 9/00 |

* cited by examiner

FIGURES

BABY BURPING DEVICE

CROSS-REFERENCE TO RELATED APPLICATION

This U.S. patent application claims priority to U.S. Provisional Application 62/673,290 filed May 18, 2018 to the above-named inventor, the disclosure of which is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to device to help "burp" a baby. In one aspect, the device is configured to secure and support the baby within a structure for contact by a mechanical arm to the upper back region of the baby to generally mimic the patting motion of caregiver frequently done after feeding to "burp" the baby.

BACKGROUND

While undertaking the care of an infant, it is often a common practice for parents to burp the baby after feeding or at a time when the infant appears to be uncomfortable. Generally, this burping is conducted by a caregiver by holding the baby in a prone position by using one hand or arm to support the upper torso region of the infant and using the second hand to gently pat or tap the back of the infant in an attempt to expel trapped air from the gastrointestinal system of the infant. Often when this trapped air is released, the baby makes a "burping" noise and appears to be more comfortable. The process of burping a baby can take several minutes and is often done multiple times a day, which adds to the caregiving burden for an infant. As caregiver's are often busy there is a need for help in aiding them in the task of burping in an infant in their care.

U.S. Pat. No. 3,071,410 entitled "Baby burp seat" discloses a tripod-like assembly for supporting a saddle for the receipt of an infant that is retained to the saddle with straps and belts. Although this device supports the infant in the prone position, it generally appears to be uncomfortable, wherein the infant is only supported along a portion of their torso with their head and neck not adequately supported. Further, this '410 reference does not include any elements to aid in patting to induce burping and still generally requires the assistance of a care giver.

Additionally, U.S. Pat. No. 7,736,325 entitled "AUTOMATIC BACK PATTER" discloses an automated device that is generally in the form of a back pack that is secured to the torso and aligned with the back of an induvial. The pack includes a power source coupled to a plurality of transmitting arms with connected patting heads configured to provide a percussive force in alternate motion between patting heads to stimulate blood flow and improve circulation of a wearer of the device.

Although these devices may be useful for their intended purpose, they lack several useful features specifically adapted for use by an infant and caregiver of an infant.

There exists a need within the marketplace for an improved baby burping device generally intended to be used by a caregiver to help burp a baby without the need hold and pat the infant during use. Preferably this device is adjustable, supports an infant along both their front and rear torso and head and neck body regions, is collapsible for easy transport, and includes integrated features to aid in keeping an area the device is used within clean and protected from spit-up or vomit during use of the device.

BRIEF SUMMARY OF THE INVENTION

In one aspect, this disclosure is related to automated baby burping device configured to support an infant during patting by a mechanical arm.

In another aspect, this disclosure is related to a hands free baby burping device configured to secure the front and back torso and head and neck regions of an infant to enable repetitive and gentle contact to the back of an infant by a mechanical arm to express trapped air from the retained infant's gastrointestinal tract.

In yet another aspect, this disclosure is related to baby burping device configured for use in the automated patting of an infant retained within the device. The device includes a base portion configured to support the device, a resting portion configured to support a retained infant, and a movable arm configured for movement in a repetitive motion to contact the back of the retained infant in a "patting" motion. Alternately, the device may include a tray portion configured for placement on a surface the device is used upon and aligned with the mouth of the retained infant to collect any expectorant during use. The device is generally provided in a collapsible/foldable assembly for easy storage and transport when not in use.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
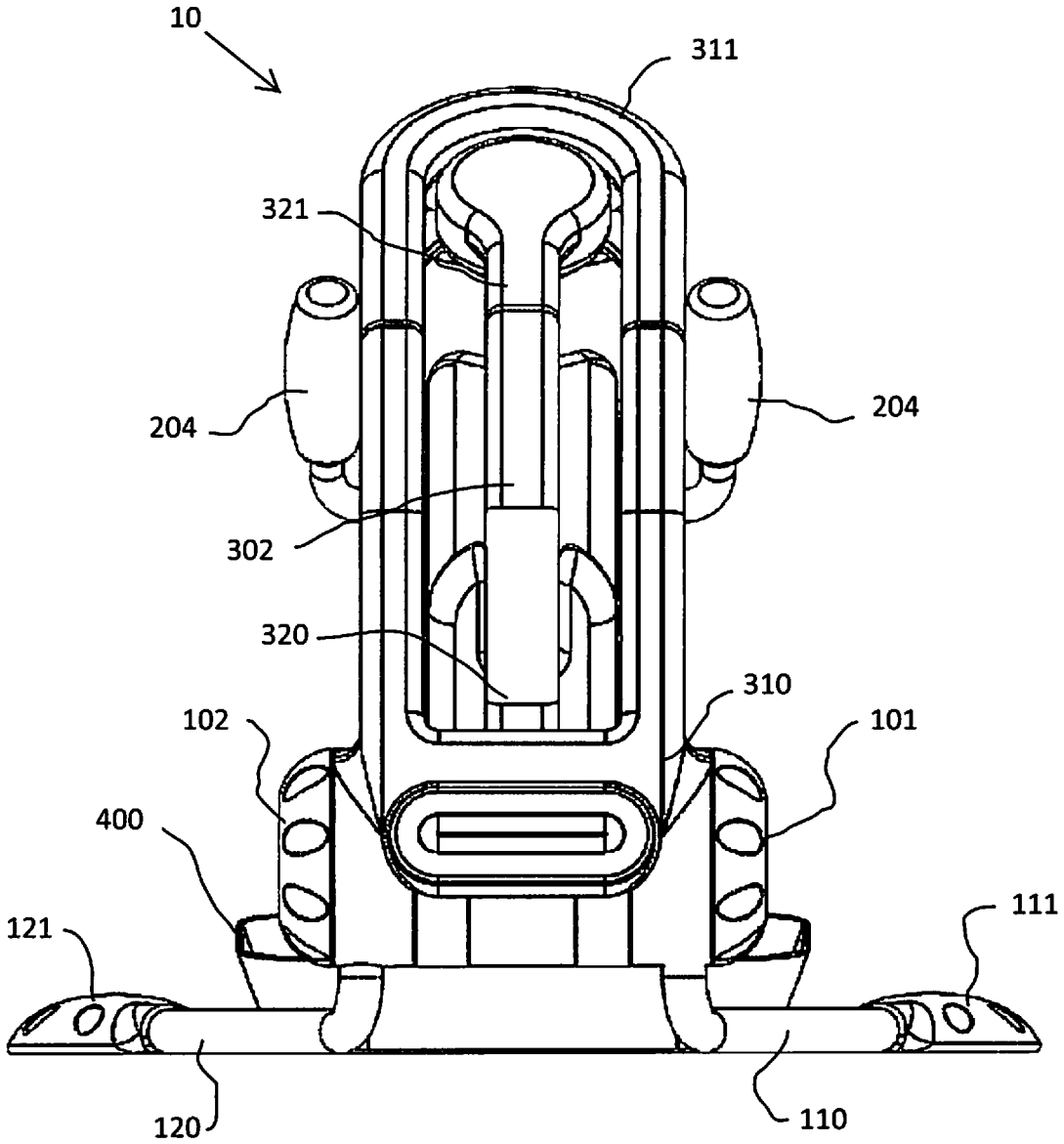
FIG. 1 is a view of the back of the device, according to the present disclosure.
Figure 2:
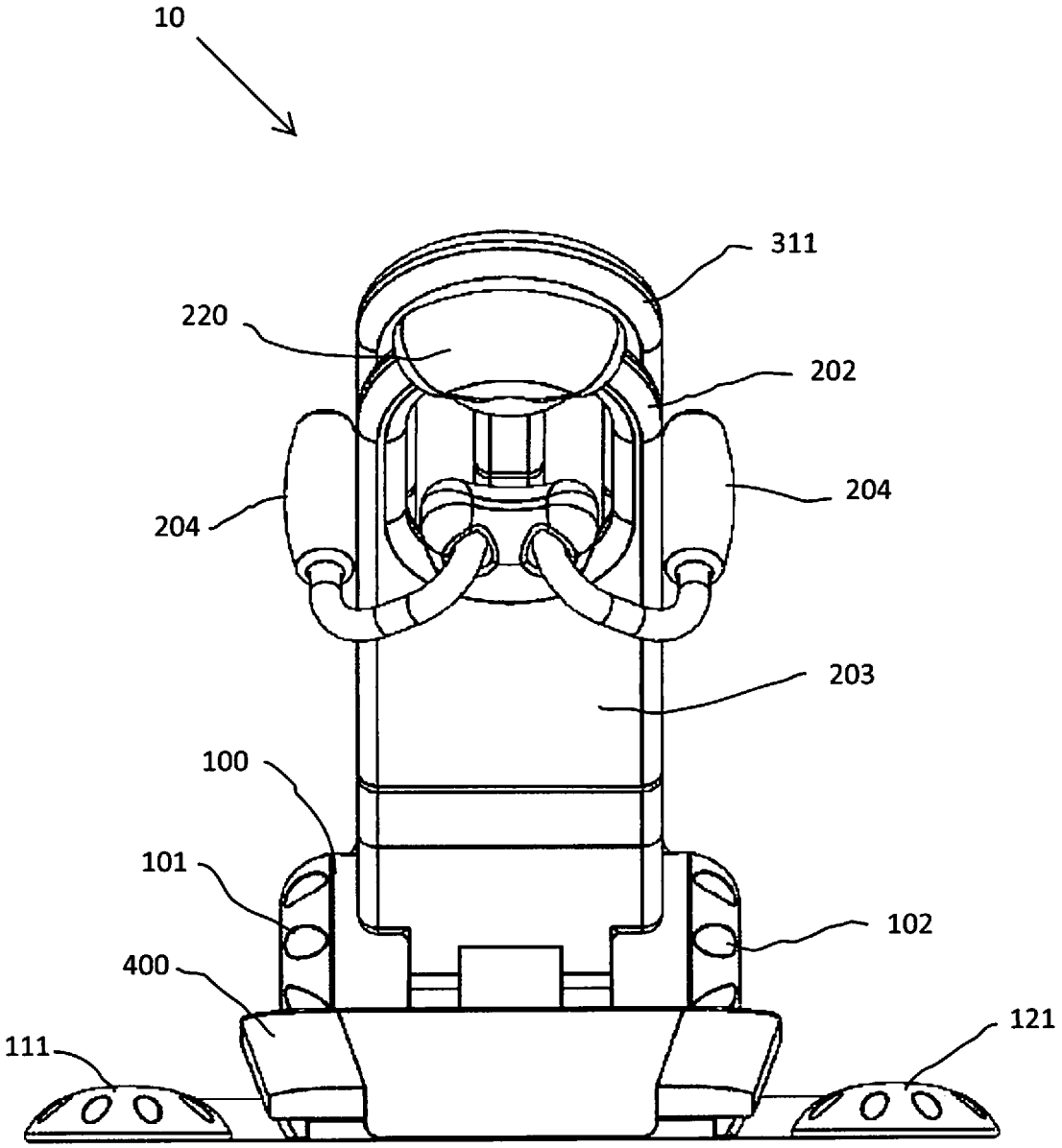
FIG. 2 is a view of the front of the device, according to the present disclosure.
Figure 3:
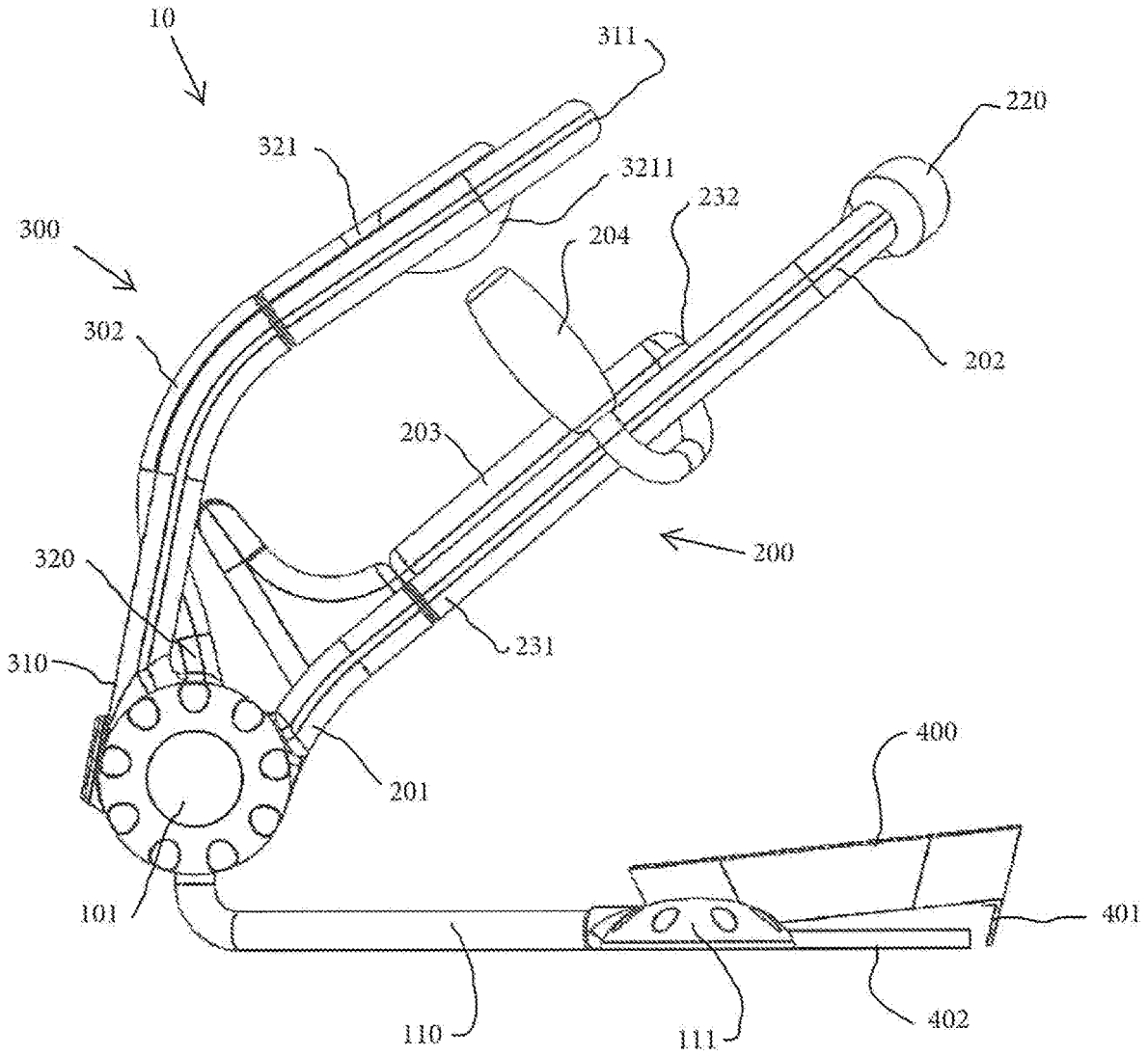
FIG. 3 is a view of the side of the device, according to the present disclosure.
Figure 4:
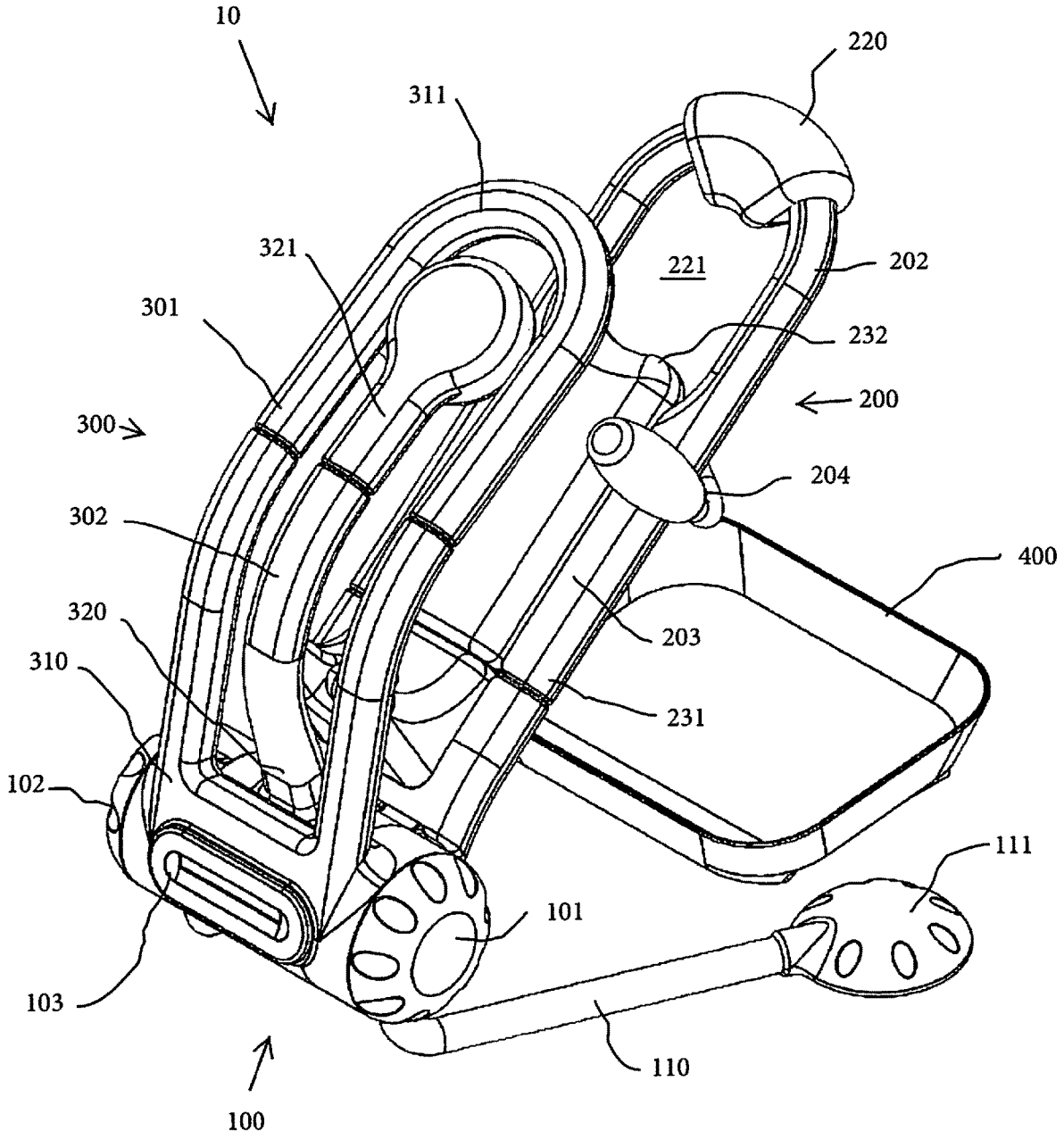
FIG. 4 is an isometric view of the device, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The disclosure of the present invention is most generally related to a device configured to aid a caregiver in "burping" a retained infant. "Burping" as used herein is generally defined as the process of expelling gas or air trapped within the gastrointestinal tract of an infant through their mouth by patting the back of the infant. Often this burping process and the resultant release of trapped air or gas soothes and comforts the infant. Accordingly, burping is most often conducted after feeding an infant and is undertaken several times a day. The device of the present disclosure is generally configured to perform the burping process on an infant by providing an ergonomic resting surface for retaining the infant during repetitive contact by an automated mechanical arm to expel trapped air.

Referring now to FIGS. 1-7 of the baby burping device of the present disclosure generally referred to as device 10. The device 10 including a base portion 100, a resting portion 200, and a movable arm portion 300 configured in a coupling to enable operation of the device 10. The base portion 100 having a cylindrical shape configured to function as pivot point for the movable receipt of a pair of legs 110, 120 and the movable arm portion 300. The base portion 100 having a first end 101 and a second end 102 opposite the first end 101, the distance between the first end 101 and the second end 102 defining a width of the base portion 100. Each of the first end 101 and the second end 102 having a leg 110, 120. Each leg 110, 120 movably received on the base 100 and extending angularly outward relative to the width of the base portion 100 and perpendicular to the width of the base portion 100 and culminating in a foot 111, 121. The angular fashion of the outward extension of the legs 110, 120 forming the support for the device 10 in use, wherein the legs 110, 120 and feet 111, 121 provide resting support for the device 10. Accordingly, the distance of a second width between the opposed feet 111, 121 is greater than the distance of the width of the base portion 100. Each foot 111, 121 of the feet providing additional surface area to the end of the legs 110, 120 to provide solid support to the device 10. A bottom surface of each of these feet 111, 121 may include a gripping surface to increase the friction between each foot 111, 121 and the surface the device 10 is resting upon. Accordingly, this gripping surface may be comprised of, but not limited to, a rubber, a plastic, a silicone, a foam, a combination of these materials, or other similar material.

The movable receipt of the legs 110, 120 on the base portion 100 configured to pivot about the cylindrical base portion 100 from a collapsed position to active position, wherein the collapsed position enables the device 10 to be generally folded or compressed for storage and the active position enables the device 10 to be supported for use.

The base portion 100 further functioning as a housing for a motor (not pictured) internally received within the base portion 100 and operable via a switch 103. A power source, either providing an alternate current or direct current, is coupled to the motor to provide power to operate the motor. The motor selected to perform a repetitive back and forth motion, to mimic a "patting" motion upon activation by the switch 103. Accordingly, the motor selected can be of any type configured to facilitate this motion, including, but not limited to, brushed, brushless, direct drive, linear, servo, and stepper motors.

The resting portion 200 generally configured to support an infant placed in a prone position during use of the device 10. The resting portion 200 generally in a fixed coupling with the base portion 100 at a fixed end 201 and extending a length to a free end 202 opposite the fixed end 201. The resting portion 200 having a planar surface 203 to support the upper torso portion of the infant. Accordingly, the infant when placed within the device will lay on the planar surface in the prone position and generally rest upon and be supported by the planar surface 203. The planar surface 203 may be constructed of a softened and padded material to provide a comfortable resting surface. The planar surface having a first end 231 adjacent the fixed end 201 and a second end 232 distal the fixed end 201 and generally adjacent the free end 202, wherein the distance between the first end 231 and second end 232 defines a length of the planar surface 203.

The resting portion 200 including a pair of movable under arm supports 204. The pair of under arm supports 204 configured for adjustment to accommodate varying sizes and body proportions of an infant received within the device 10. The pair of under arm supports 204 positioned on opposed sides of the resting portion 200 planar surface 203 at a position generally aligned with the armpit region/area of the retained infant. In the preferred embodiment of the present disclosure, each underarm support 204 of the pair of underarm supports 204 is rotationally received on an underside of the planar surface 203, wherein this rotational receipt enables movement of the underarm supports 204 along the length of the planar surface 203.

The free end 202 of the resting support 200 generally configured to support the head and neck region of the retained infant through a headrest 220. The headrest 220 generally forming a padded surface to receive the forehead of the retained infant. The headrest 220 spaced apart from the second end 232 of the planar surface 203 to define an opening 221 for the placement of the face of the retained infant.

Figure 5:
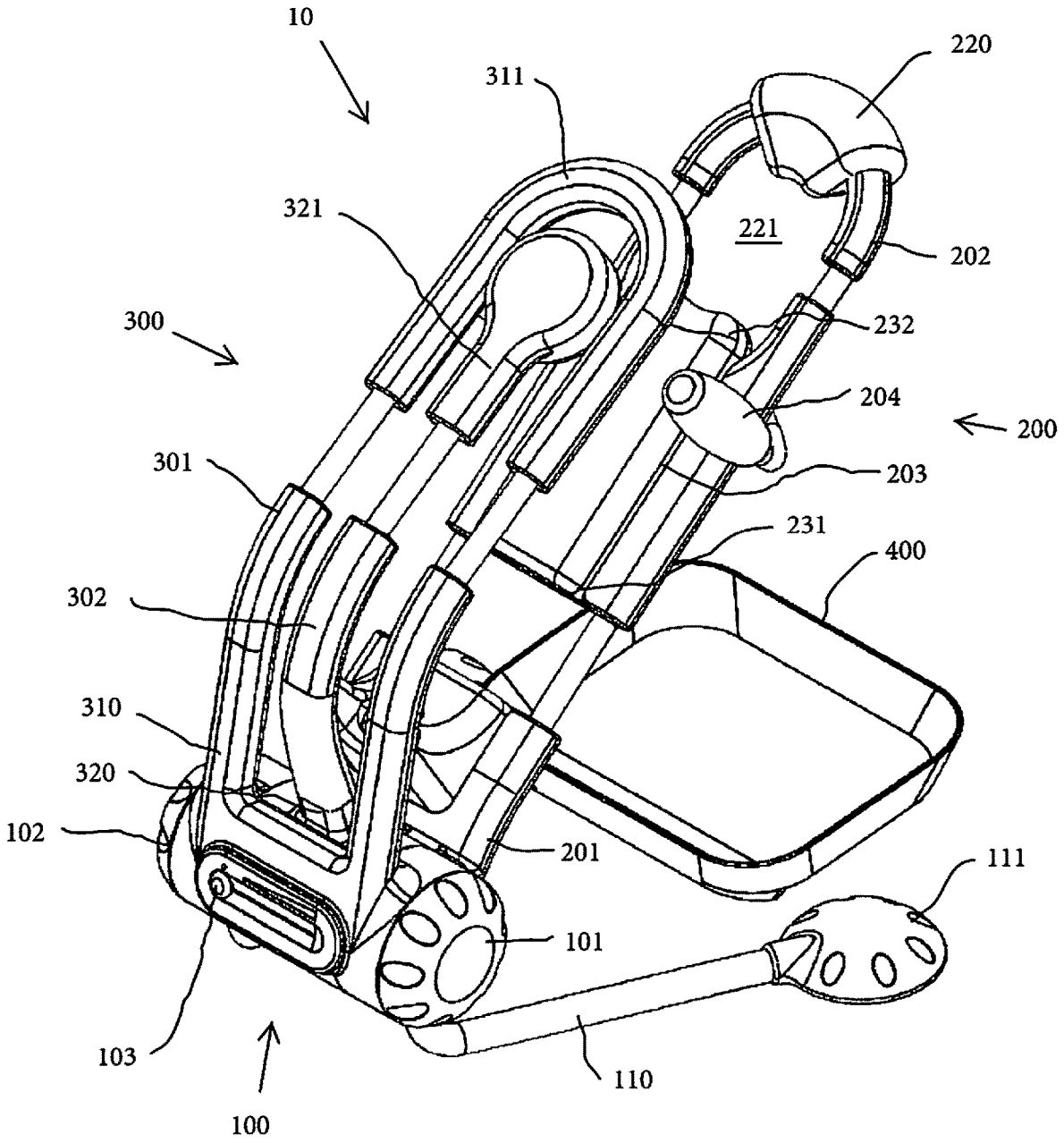
FIG. 5 is an isometric view of the device in an expanded position, according to the present disclosure.
Figure 6:
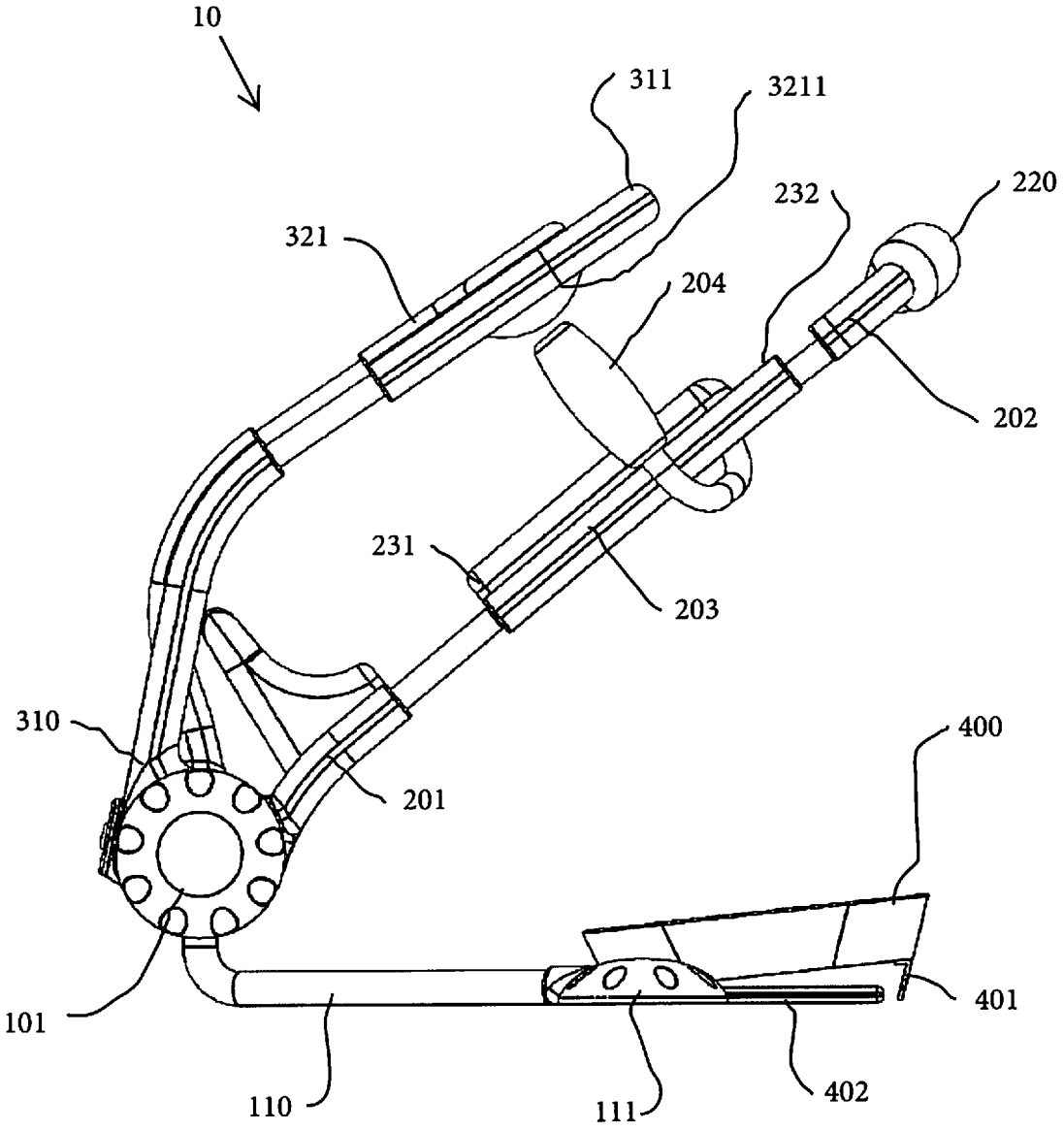
FIG. 6 is a side view of the device in the expanded position, according to the present disclosure.
Figure 7:
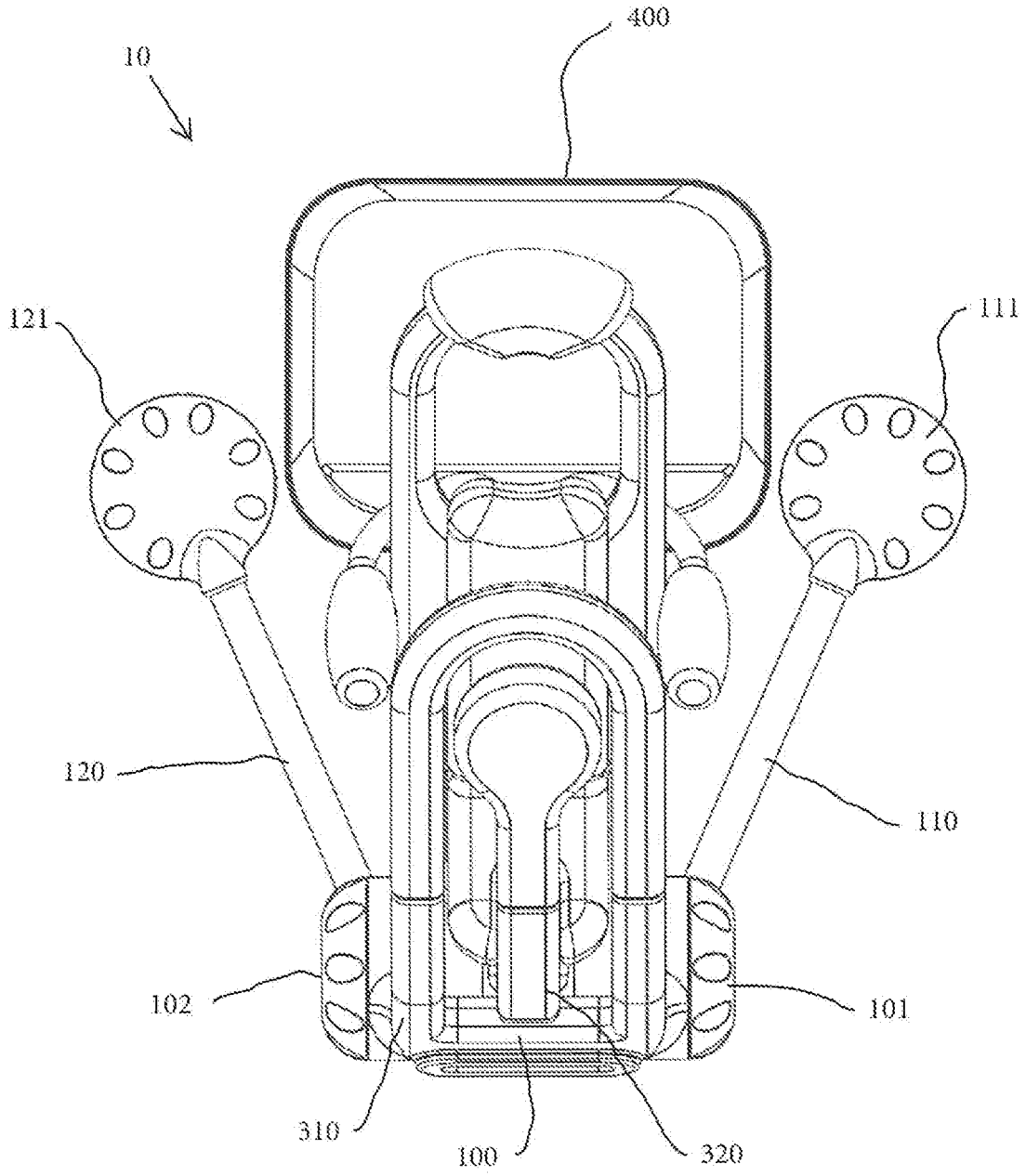
FIG. 7 is a top view of the device, according to the present disclosure.

The resting portion 200 as is seen in FIG. 5-6, is configured for adjustment wherein it is movable to an extended position along the length to allow the device 10 to fit several lengths and sizes of infants. Accordingly, the resting portion 200 is movable relative to the connection with the base portion 100 at a pair of locations along the length. The first location positioned between the fixed end 201 and the first end 231 of the planar surface 203 and the second location between the second end 232 of the planar surface 203 and the free end 202, wherein the first end 231 is movable away from the fixed end 201 and the free end 202 is movable away from the planar surface 203 opposite the fixed end 201.

The movable arm portion 300 movably received on the base portion 100 opposite the legs 110, 120 with the resting portion 200 positioned on the base portion 100 between the legs 110, 120 and the movable arm portion 300. The movable arm 300 having an outer retaining member 301 and inner arm 302. The outer retaining member 301 having an attached end 310 and free end 320. The outer retaining member 301 configured for movement about the central portion 100 and generally capable of moving to a position adjacent to the rear torso or back area of the infant when placed on the planar surface 203 to generally retain the infant in the device 10 and on the planar surface 203. The outer retaining member 301 is configured for adjustment wherein it is movable to an extended position along a length between the attached end 310 and the free end 320 to allow the device 10 to fit several lengths and sizes of infants. Accordingly, the outer retaining member 301 is movable relative to the connection with the base portion 100 at a location along the length of the outer retaining member 301.

The inner arm 302 of the movable arm portion 300 generally positioned at an interior space of the outer retaining member 301 for alignment with a central area of the upper rear torso or upper back area of the infant, wherein the inner arm 302 is configured to simulate a "burping" action. Accordingly, the inner arm 302 having a first end 320 affixed to the motor and a second end 321 positioned distal the first end, with the distance between the first end 320 and the second end 321 defining a length of the inner arm 302. The length adjustable wherein it is movable to an extended position between the first end 320 and the second end 321 to allow the device 10 to fit several lengths and sizes of infants and be adjusted to be in proper alignment with the upper rear torso of the infant. Accordingly, the inner arm 302 is extendable relative to the connection with the base portion 100 at a location along the length of the inner arm 302.

Movement of the inner arm 302 pivoting about the base portion 100 in a direction towards the planar surface 203 and away from the planar surface 203 directionally opposite the legs 110, 120 in a back and forth motion to simulate "burping". Accordingly, the switch 103 controls the motor to change the frequency of the movement of the inner arm 302, wherein it moves in a faster or slower back and forth motion. In use of the device 10, the user will operate the switch 103 to activate the motor to control movement of the second end 321 to soothe the retained infant.

The second end 321 having a bulbous shape 3211 having a padded region aligned with the infant for contact to simulate a human hand, wherein contact with the infant is gentle, but firm. Accordingly, the second end 321 contacts the infant in a repetitive motion in an attempt to expel the trapped air and gas within the gastrointestinal tract of the infant.

In a preferred embodiment of the present disclosure, the device 10 includes a tray 400 configured to capture expelled fluids, spit-up, or vomit from the retained infant during use. The tray 400 having a size and shape configured for placement between the legs 110, 120 and aligned with the opening 221, wherein the tray 400 is positioned in the preferred position for capturing the expelled fluids. The tray 400 constructed out of a transparent material to allow for the placement of an item 402 under the tray 400, wherein the item 402 is visible to the retained infant. The item 402 including, but not limited to, a personal electronic device, such as a tablet, a photograph, or other visible medium configured to attract the attention of the infant. To facilitate the placement of the item, the tray includes a leg member 401 to raise the tray 400 above a surface the device 10 is placed upon to allow for placement of the item 402 under the tray 400 for viewing.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A device configured to retain an infant for burping the infant, the device comprising:

a base portion, the base portion including a motor;

a resting portion, the resting portion coupled to the base portion and configured to support the infant in a prone position; and a movable arm portion, the movable arm portion coupled to the motor adjacent to the resting portion, the movable arm portion configured to move in a direction towards the resting portion and away from resting portion in a repetitive motion, wherein the resting portion has a fixed end and the movable arm portion has an attached end, wherein the fixed end and the attached end are coupled to opposed sides of the base portion in an angular assembly configured to define a space, between the resting portion and the movable arm portion, for secure receipt of the infant; wherein the base portion has a first end and a second end opposite the first end, a distance between the first end and the second end defining a width of the base portion, each of the first end and the second end having a leg, the legs extending outward from the base portion perpendicular to the width, wherein the movable arm portion is positioned on the base portion opposite the legs with the resting portion positioned on the base portion between the legs and the movable arm portion.

2. A device as in claim 1, wherein the legs are movably received on the base portion.

3. A device as in claim 2, wherein the legs extend angularly outward relative to the width of the base portion, wherein a distance between the legs defines a second width, the second width being greater than the first width.

4. A device as in claim 3, wherein each leg of the legs includes a foot, the foot positioned on an end of the leg opposite the base portion.

5. A device as in claim 1, wherein the resting portion has a free end opposite the fixed end, wherein the distance between the free end and the fixed end define a length of the resting portion, the length adjustable to support several sizes and lengths of the infant.

6. A device as in claim 5, wherein the movable arm portion has a length extending from the attached end, the length adjustable to support several sizes and lengths of the infant.

7. The device as in claim 1, further comprising a pair of movable under arm supports, each movable under arm support of the pair of movable under arm supports positioned on opposed sides of the resting portion.

8. A device configured to retain an infant for burping the infant, the device comprising:

a base portion, the base portion cylindrical in shape and forming a housing for a motor, the base portion having:

a first end;

a second end opposite the first end, a distance between the first end the second end defining a width of the base portion;

a pair of legs, each leg of the pair legs movable received on and pivoting about the base portion, each leg of the pair of legs extending angularly outward perpendicular to the width culminating in a foot, wherein a distance between each foot on each leg of the pair of legs defines a second width, the second width greater than the width of the base portion;

a resting portion, the resting portion coupled to the base portion and configured to support the infant in a prone position, the resting portion having a fixed end, the fixed end coupled to the base portion;

a free end, the free end opposite the fixed end, a distance between the fixed end and the free end defining a length of the resting portion;

a planar surface, the planar surface configured to support an upper torso of the infant, the planar surface having:

a first end, the first end adjacent to the fixed end;

a second end, the second end distal the first end, the distance between the second end and the first end defining a length of the planar surface;

a pair of movable under arm supports, each movable under arm support of the pair of movable under arm supports positioned on opposed sides of the planar surface and configured to be adapted at a position aligned with an armpit region of the infant retained within the device;

a headrest, the headrest padded and positioned on the free end and spaced apart from the second end of the planar surface to define an opening, wherein the opening is configured to receive a face of the infant; and a movable arm portion, the movable arm portion movably received on the base portion, the movable arm having:

an outer retaining member, the outer retaining member having an attached end and a free end opposite the attached end, wherein the outer retaining member is configured to retain the infant against the planar surface; and an inner arm, the inner arm coupled to the motor and configured to move in a direction towards the resting portion and away from resting portion in a repetitive motion.

9. A device as in claim 8, wherein the resting portion is movable to an extended position along the length.

10. A device as in claim 9, wherein the resting portion is movable to an extended position at a first location between the fixed end and the first end of the planar surface and a second location between the second end of the planar surface and the free end.

11. A device as in claim 8, wherein the inner arm has a first end and a second end distal the first end, the distance between the first end and the second end defining a length of the arm, the length adjustable, wherein it is movable to an extended position to fit several sizes of infants.

12. A device as in claim 11, wherein the inner arm second end has a bulbous end.

13. A device as in claim 8, wherein a switch is coupled to the motor, the switch alters the frequency of the movement repetitive motion of the inner arm.

14. A device as in claim 8, wherein the device includes a tray.

15. A device as in claim 14, wherein the tray is sized for receipt between the second width of the legs.

16. A device as in claim 15, wherein the tray is transparent and configured for the receipt of an item of interest at an underside of the tray.

* * * * *